US006318216B1

(12) United States Patent
Eggert et al.

(10) Patent No.: US 6,318,216 B1
(45) **Date of Patent: *Nov. 20, 2001**

(54) COMPOSITE BOX WRENCH WITH REINFORCING AND RETAINING STRUCTURE

(75) Inventors: Daniel M. Eggert, Kenosha; Marco E. DeVecchis, Racine, both of WI (US); Michael Q. Thompson, Waukegan, IL (US); Stacy T. Spracklin, Kenosha, WI (US)

(73) Assignee: Snap-on Technologies, Inc., Lincolnshire, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 270 days.

(21) Appl. No.: 08/852,681

(22) Filed: May 7, 1997

(51) Int. Cl.[7] ..... B25B 13/46
(52) U.S. Cl. ..... 81/61; 81/900; 81/124.3
(58) Field of Search ..... 81/124.3, 60–63.2, 81/59.1, 900, 119, 121.1, 124.4, 124.7, 125.1

(56) References Cited

U.S. PATENT DOCUMENTS

| | | | |
|---|---|---|---|
| D. 332,730 | 1/1993 | Usuda . | |
| D. 342,653 | 12/1993 | Macor . | |
| 2,720,799 | 10/1955 | Pfost . | |
| 2,978,353 | 4/1961 | Meier . | |
| 3,682,023 | 8/1972 | Greene, Jr. . | |
| 3,742,787 | 7/1973 | Whiteford . | |
| 3,742,788 | 7/1973 | Priest . | |
| 4,111,077 | 9/1978 | Cummings et al. . | |
| 4,123,953 | 11/1978 | Corbacho, Jr. . | |
| 4,302,990 | 12/1981 | Chricton et al. . | |
| 4,334,563 * | 6/1982 | Epel et al. . | |
| 4,683,784 | 8/1987 | Lamont . | |
| 4,738,169 | 4/1988 | Wyka . | |
| 4,770,072 | 9/1988 | Neuhaus . | |
| 4,873,742 | 10/1989 | Dillon . | |
| 4,986,147 | 1/1991 | Cooper . | |
| 5,001,947 | 3/1991 | Andersen-Vie . | |
| 5,062,328 * | 11/1991 | Demurger | 81/186 |
| 5,095,781 | 3/1992 | Blake et al. . | |
| 5,144,869 | 9/1992 | Chow . | |
| 5,172,614 | 12/1992 | Monnet et al. . | |

(List continued on next page.)

*Primary Examiner*—D. S. Meislin
(74) *Attorney, Agent, or Firm*—Seyfarth Shaw

(57) ABSTRACT

A composite box end wrench has a non-metallic body including a handle portion and at least one head portion which defines a fastener-receiving opening therethrough. The wrench includes strengthening and/or retaining structure which strengthens the head portion and can change the failure mode to confine wrench parts in the event of failure. In one embodiment each head portion has a fastener-engaging member insert molded therein along with a reinforcing plate which encircles the member and preferably extends slightly into the handle portion. The reinforcing structure could alternatively be a band extending the length of the wrench and encircling the fastener-engaging member (or members in a double-ended wrench). In a ratcheting version of the wrench the non-metallic body may be split lengthwise into two parts, each of which has reinforcing structure embedded therein, the fastener-engaging member being a ratchet gear which, along with an associated pawl, is disposed between the body parts. The parts may either confine or expose a peripheral portion of the gear, and the reinforcing structure encircles hub portions of the pawl and gear to the hold them together. The body parts may be secured together by various means, including pinning, ultrasonic welding and snap-fitting. The wrench body may be provided with an outer non-metallic sheath, in addition to or in lieu of the reinforcing structure, which sheath covers at least the handle portion of the body.

23 Claims, 5 Drawing Sheets

U.S. PATENT DOCUMENTS

| | | | | |
|---|---|---|---|---|
| 5,271,300 | | 12/1993 | Zurbuchen et al. . | |
| 5,309,796 | | 5/1994 | Jones . | |
| 5,325,744 | | 7/1994 | Horikawa . | |
| 5,394,773 | | 3/1995 | Zurbuchen et al. . | |
| 5,461,950 | | 10/1995 | Iwinski . | |
| 5,493,756 | | 2/1996 | Shanok et al. . | |
| 5,528,963 | | 6/1996 | Wei . | |
| 5,603,247 | | 2/1997 | Wei . | |
| 5,626,061 | | 5/1997 | Whitley . | |
| 5,713,251 | * | 2/1998 | Zurbuchen et al. | 81/61 |
| 5,875,693 | * | 3/1999 | Zurbuchen et al. | 81/63.2 |

* cited by examiner

COMPOSITE BOX WRENCH WITH REINFORCING AND RETAINING STRUCTURE

BACKGROUND OF THE INVENTION

1. Field of the Invention

The present invention relates to hand tools, such as wrenches, and particularly to tools formed of non-metallic materials. The invention has particular application to wrenches, such as box end wrenches, of both the ratcheting and non-ratcheting type.

2. Description of the Prior Art

The present invention is an improvement of composite wrenches of the type disclosed, e.g., in U.S. Pat. No. 5,394,773 and in copending U.S. application Ser. No. 08/784,527 filed Jan. 17, 1997. Both the patent and the copending application relate to composite box end wrenches with fastener-engaging inserts, the copending application disclosing a ratcheting wrench wherein the ratchet mechanism is confined in a module, which is insert molded in the head end of the wrench body. These prior composite wrenches, which are compression molded of sheet molding compound, afford important electrically insulating, non-sparking and non-marring qualities. However, it has been found that, when such wrenches are injection molded of high-strength plastic material, they can break apart during testing to failure.

Another problem typically experienced in ratcheting box wrenches is that, during application of high torque, the torquing forces tend to try to pull the ratchet gear away from the pawl. In very high torque applications this can cause malfunction of the ratchet mechanism. This problem is alleviated by the encapsulating module utilized in the aforementioned copending application, because the module housing engages the hubs of both the pawl and the gear for holding them together. However that arrangement is relatively expensive to manufacture.

SUMMARY OF THE INVENTION

It is a general object of the invention to provide an improved composite wrench which avoids the disadvantages of prior wrench constructions while affording additional structural and operating advantages.

An important feature of the invention is the provision of a composite box end wrench with a fastener-engaging insert which is reinforced so as to strengthen the wrench by increasing the surface area of the interface between the insert and the composite material to reduce stresses at the interface.

Still another feature of the invention is the provision of a ratcheting box end wrench of the type set forth, wherein the reinforcing structure serves to inhibit separation of the ratchet pawl and gear during high torque operations in an economical manner.

Yet another feature of the invention is the provision of an injection molded composite wrench construction which retains wrench parts intact in the event of failure of the wrench.

Certain features of the invention are attained by providing a box end wrench comprising a body formed entirely of nonmetallic material and including a handle portion and a head portion, a fastener-engaging member embedded in and encompassed by the head portion and defining a fastener-receiving opening, and a reinforcing structure embedded in the body and encompassing the fastener-engaging member.

Other features of the invention are attained by providing a ratcheting box end wrench comprising a housing including two parts formed of non-metallic material and each having a handle portion and a head portion which defines an opening, each of the head portions including reinforcing structure embedded therein and encompassing the opening, the parts being joined together to form a wrench body having a handle formed by the handle portions and a head formed by the head portions with the openings aligned to define a hole through the head, and a fastener-engaging member captured between the head portions and disposed in the hole for engagement with the reinforcing structures.

Still other features of the invention are attained by providing a wrench comprising an inner solid body formed entirely of a first non-metallic material and including a handle portion and a head portion having a fastener-receiving opening therein, and an outer sheath formed of a second non-metallic material and surrounding at least the handle portion of the inner body.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
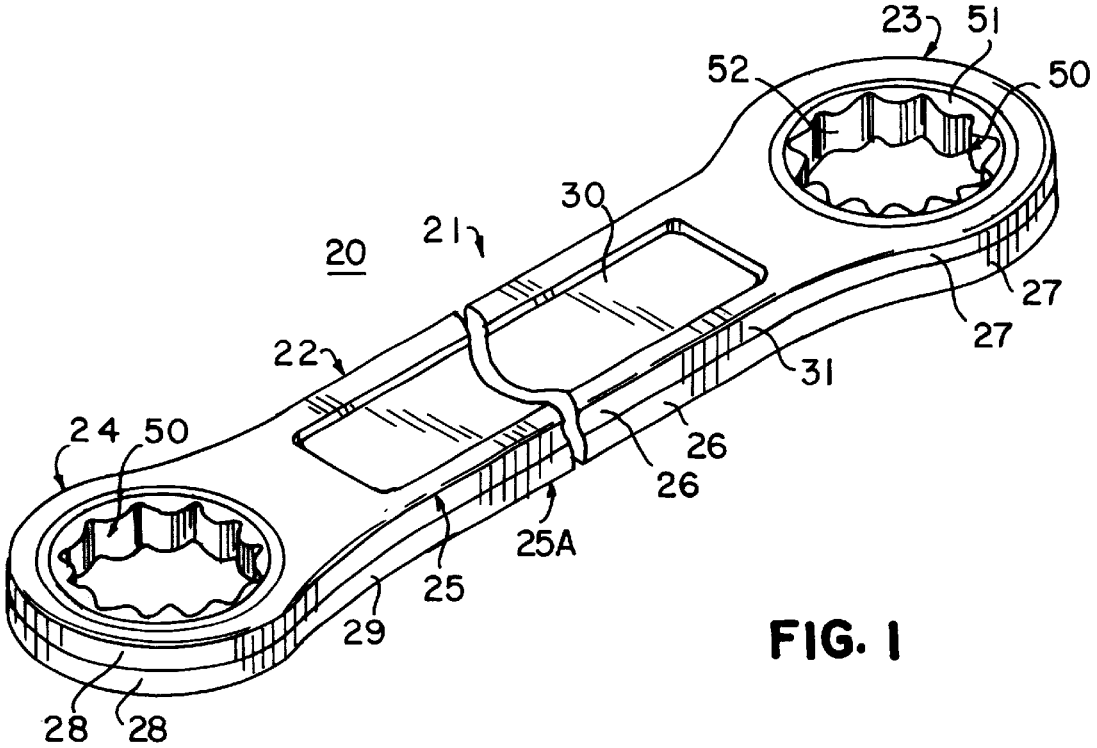
FIG. 1 is a perspective view of a ratcheting box end wrench with a two-part body constructed in accordance with a first embodiment of the present invention, with portions removed to foreshorten the illustration.
Figure 2:
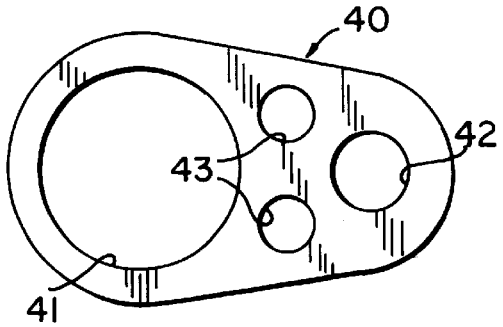
FIG. 2 is a top plan view of a reinforcing plate used in the wrench of FIG. 1.
Figure 3:
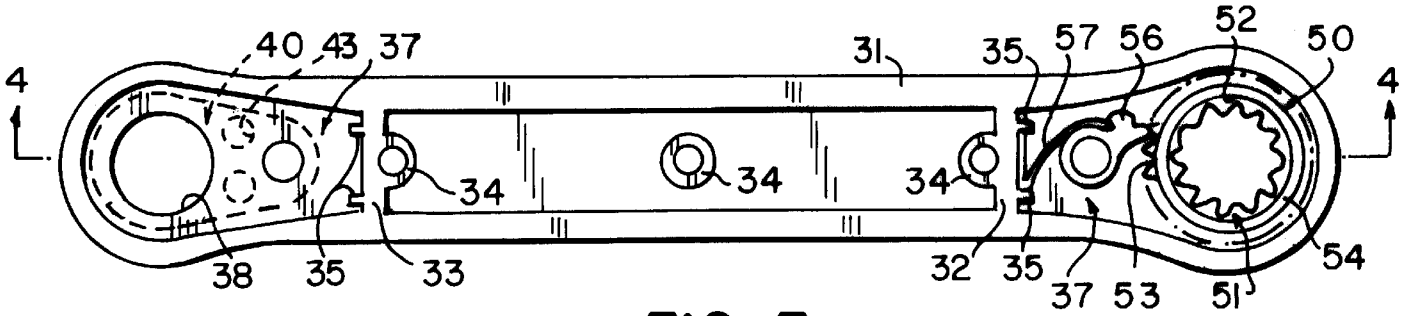
FIG. 3 is a reduced top plan view of one part of the two-part body of the wrench of FIG. 1, and illustrating the ratchet mechanism at one end of the wrench.

Referring to FIGS. 1–5, there is illustrated a hand tool in the nature of a ratcheting box end wrench 20, constructed in accordance with and embodying the features of a first embodiment of the present invention. The wrench 20 has a non-metallic body 21 including an elongated handle 22 provided with heads 23 and 24 at the opposite ends thereof, which may be of the same or different sizes. The body 21 is formed of two molded parts 25 which are substantially identical in construction, wherefore like portions of each part will bear the same reference numbers, although one has been designated 25A so that the two parts can be distinguished. Preferably, each of the parts 25 and 25A is injection molded of a non-metallic material, preferably a high-strength polymer, such as a 60% glass-filled nylon material. Each part has an elongated handle portion 26 provided at the opposite ends thereof with head portions 27 and 28, the parts 25 and 25A being joined with their inner sides facing each other along a parting line 29, so that the handle portions 26 form the handle 22, the head portions 27 form the head 23 and the head portions 28 form the head 24.

Each of the parts 25 and 25A includes an elongated, substantially flat base wall 30 provided around the periphery thereof with an upstanding peripheral side wall 31, the opposite sides of which are joined by transverse walls 32 and 33, respectively adjacent to the opposite ends of the handle portion 26. Projecting from the inner surface of the base wall 30 substantially the same height as the peripheral side wall 31 are three hollow cylindrical bosses 34, two of which are respectively integral with the facing sides of the transverse walls 32 and 33. Each of the transverse walls 32 and 33 has formed on the opposite or head-facing side thereof two laterally spaced-apart and forwardly extending projections 35. The peripheral side wall 31 has a flat planar end surface 36 substantially parallel to the base wall 30, and cooperates with the transverse walls 32 and 33 to define two ratchet mechanism cavities 37, respectively at the head portions 27 and 28. Formed through the base wall 30 in each of the cavities 37 is a large-diameter circular hole 38. Also formed in the base wall 30 in each cavity 37 is a smaller-diameter circular recess 39 aligned with the hole 38 axially of the wrench body 21.

Respectively insert molded in the head portions 27 and 28 are reinforcing structures in the form of two appropriately sized substantially flat, generally pear-shaped reinforcing plates 40 (see FIG. 2), preferably formed of a suitable metal, such as steel. The reinforcing plates 40 are disposed in the base wall 30 substantially parallel to the inner and outer surfaces thereof, as can best be seen in FIGS. 4 and 5, each plate 40 having a large-diameter gear hole 41 therethrough disposed substantially congruent to the hole 38 in the associated head portion 27 or 28, and a smaller-diameter pawl hole 42 disposed substantially congruent with the associated recess 39. Each plate 40 is disposed in the associated head portion 27 or 28 at a depth slightly above the base of the recess 39. Each reinforcing plate also has formed therethrough two small-diameter holes 43 between the holes 41 and 42, which are filled with the plastic material during the molding operation to assist in anchoring the reinforcing plate 40 in the part 25 and to help prevent pieces of the wrench from breaking of f in the event of an overload failure.

Figure 5:
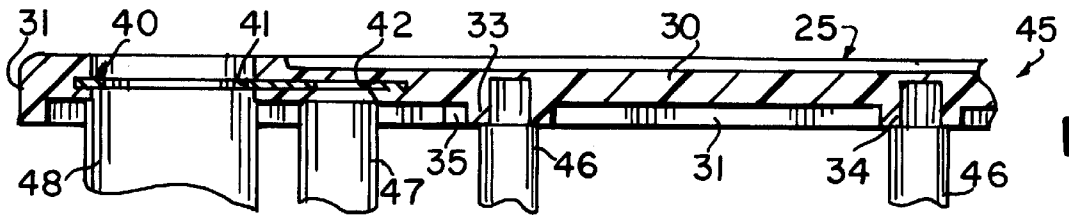
FIG. 5 is an enlarged, fragmentary, sectional view of a portion of a mold for forming the body part of FIG. 4.

Referring to FIG. 5, there is illustrated a portion of a mold apparatus 45 usable in molding the parts 25. This apparatus preferably includes three core pins 46 to respectively define the cylindrical bosses 34 and core pins 47 and 48 (one each shown) for respectively forming the recesses 39 and the holes 38. While, in the preferred embodiment, the parts 25 are formed by injection molding, it will be appreciated that other types of molding could be used, such as compression molding of layers of sheet molding compound by a technique similar to that disclosed in the aforementioned U.S. Pat. No. 5,394,773.

The wrench 20 also includes two ratchet mechanisms 50, respectively disposed in the heads 23 and 24, the ratchet mechanisms 50 being substantially identical in construction, with the possible exception of size, wherefore only one will be described in detail. The ratchet mechanism 50 includes a ratchet gear 51 having an internal fastener-engaging surface 52, which is illustrated as having a 12-point configuration, but which could have any of a number of other different configurations, such as hexagonal, double hexagonal, square drive and the like. The gear 51 is provided at its outer periphery with radially outwardly extending and equiangularly spaced ratchet teeth 53. The gear 51 is provided with a cylindrical hub 54 between the teeth 53 and the fastener-engaging surface 52, which extends axially from the teeth 53 in both directions and is dimensioned to be rotatably received in the holes 38 of the associated wrench head 23 or 24. The ratchet mechanism 50 also includes a pawl 55, having a pivot hub or pin 56 dimensioned to be rotatably received in the recesses 39 of the wrench 20 for ratcheting engagement with the gear teeth 53. A leaf spring 57 is seated in the space between the projections 35 and resiliently urges the pawl 55 into engagement with the gear teeth 53 in a known manner, as can best be see in FIG. 3.

Figure 4:
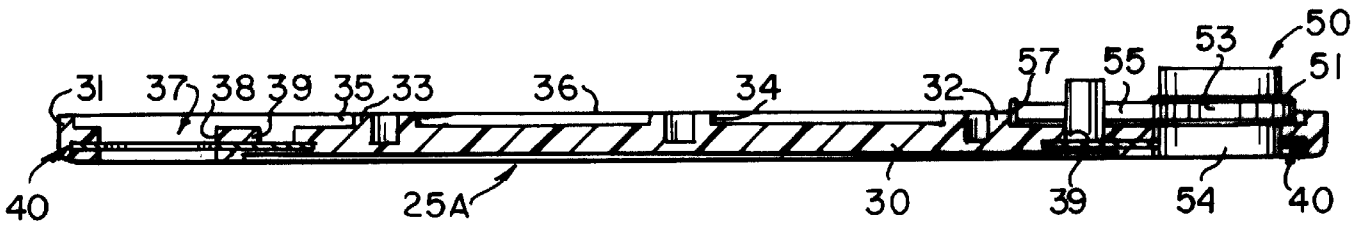
FIG. 4 is a view in vertical section taken along the line 4—4 in FIG. 3.

In assembly, the ratchet mechanisms 50 are seated in the head portions 27 and 28 of one part 25A, as illustrated in the right-hand end of FIG. 4. Then the other part 25 is fitted over the part 25A, so that the ratchet mechanisms 50 are respectively confined in the cavities 37, being completely encompassed by the base walls 30 and the peripheral side walls 31 of the parts 25 and 25A. When thus assembled, it can be seen that the gear hubs 54 fit through the holes 41 in the reinforcing plates 40, while the pawl hubs 56 fit through the holes 42 in the reinforcing plates 40. The parts 25 and 25A may be fixedly secured together by suitable means, such as by pins disposed in the aligned bosses 34. However, it will be appreciated that any of a number of different joining techniques could be used, such as suitable adhesives, ultrasonic welding and the like, with appropriate modification of the structure of the parts 25 and 25A as would be well understood by those of ordinary skill in the art.

It is a significant aspect of the invention that, when thus assembled, the reinforcing plates 40 cooperate with the gears 51 and the pawls 55 of the ratchet mechanisms 50 to significantly increase the strength of the wrench 20, increasing the ultimate torque at which failure is likely to occur. It is also important that the reinforcing plate 40 influences the failure mode such that, when the wrench 20 is tested to failure, the wrench tends not to break apart. Also, because the reinforcing plates 40 engage the gears 51 and the pawls 55, they positively inhibit the tendency of those ratchet mechanism parts to separate from each other during high-torque applications. All of these advantages are achieved in a relatively simple and economical construction.

Figure 6:
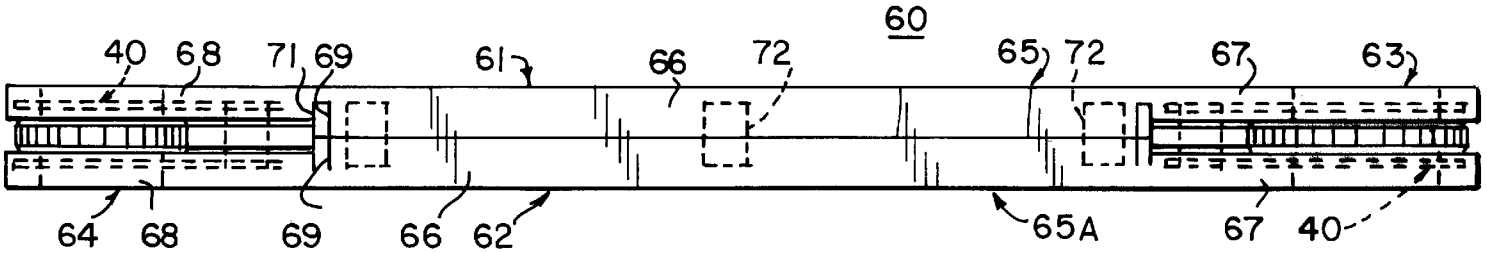
FIG. 6 is a side elevational view of a ratcheting box end wrench in accordance with another embodiment of the invention.
Figure 7:
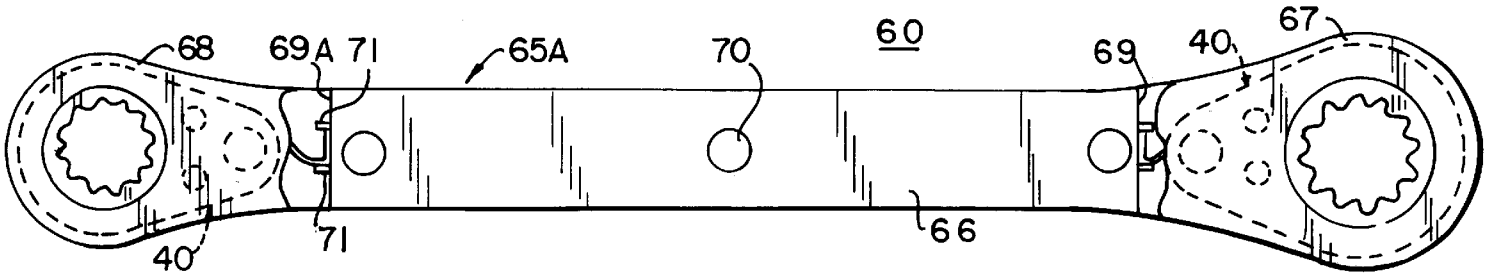
FIG. 7 is a top plan view of the wrench of FIG. 6, with the central portion of the upper part broken away.

Referring now to FIGS. 6 and 7, there is illustrated an alternative embodiment of the present invention in the form of a ratcheting box end wrench, generally designated by the numeral 60. The wrench 60 has a non-metallic body 61 including an elongated handle 62 provided with heads 63 and 64 at the opposite ends thereof. Again, the body 61 is formed of two substantially identical parts 65 and 65A, each including a handle portion 66 and head portions 67 and 68. The handle portion 66 is substantially thicker than the heads portion 67 and 68, being joined thereto by steps or shoulders 69. Formed in the handle portion 66 are three longitudinally spaced-apart, circular recesses 70. Integral with each of the shoulders 69 and projecting therefrom into the adjacent head portion 67 or 68 are a pair of laterally spaced-apart projections 71.

The ratchet mechanisms 50 are assembled in the parts 65 and 65A in substantially the same manner as was described above in connection with the wrench 20, with each leaf spring 57 being seated between the adjacent projections 71. The parts 65 and 65A may be joined by pins 72 or by any of the other alternative techniques described above. There results a ratcheting box end wrench 60 which is substantially like the wrench 20, described above, except that, because the parts 65 and 65A do not have the upstanding peripheral side wall, the ratchet mechanisms 50 are exposed between the head portions 67 and 68.

Figure 8:
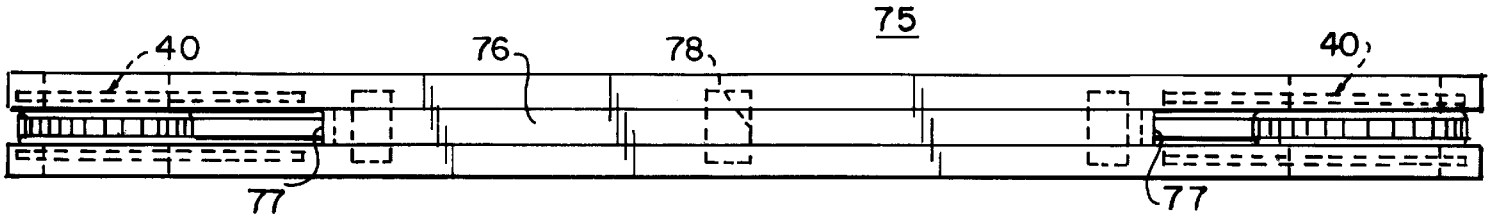
FIG. 8 is a view similar to FIG. 6 of another embodiment of the present invention.

The wrench body of FIGS. 6 and 7 could be formed of a three-part construction rather a two-part construction. Thus, referring to FIG. 8, a wrench 75 is illustrated in which each of the outer body parts has substantially the same thickness along its entire length. Instead of the steps or shoulders 69, an intermediate spacer 76 is disposed between the handle portions of the outer parts, the spacer 76 having leaf spring seating recesses 77 formed in the opposite ends thereof and having pin holes 78 formed therethrough for receiving the joining pins 72 in the event that that joining technique is used.

Figure 9:
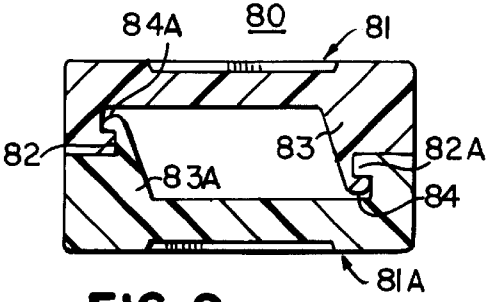
FIG. 9 is an enlarged view in vertical section illustrating an alternative technique for holding together the parts of the wrenches of FIGS. 1–8.

In addition to the joining techniques described above, the parts of the wrench body could be designed to be snap-fitted together. Thus, referring to FIG. 9, there is illustrated a wrench 80 formed of mating parts 81 and 81A, respectively having laterally inwardly extending flanges 82 and 82A along one side of the peripheral side wall thereof and having hooks 83 and 83A at the opposite sides thereof, respectively having tabs 84 and 84A designed to snap-fit into engagement with the flanges 82A and 82, as illustrated.

Figure 10:
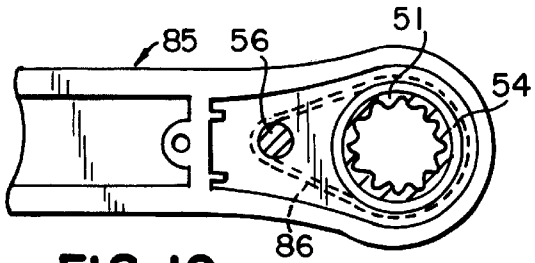
FIG. 10 is a fragmentary view similar to FIG. 3, illustrating an alternative form of reinforcing structure.

While, in the preferred embodiments described above, the reinforcing structure is in the form of flat reinforcing plates 40, it could be in the form of an elongated band. Thus, referring to FIG. 10, there is illustrated a wrench part 85, which is substantially identical to the wrench part 25 illustrated in FIG. 3, except that the reinforcing structure is in the form of an elongated continuous band 86 defining a loop which encircles the hub 54 of the ratchet gear 51 and the hub 56 of the pawl 55. Preferably, the band 86 is in the form of a rigid metal band which is insert molded in the part 85 in the same manner as described above.

Figure 11:
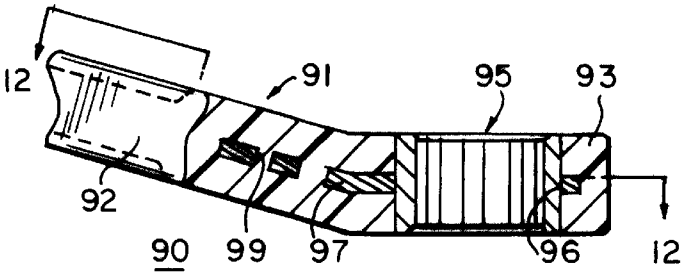
FIG. 11 is a fragmentary side elevational view in partial section of a non-ratcheting box end wrench in accordance with another embodiment of the invention.
Figure 12:
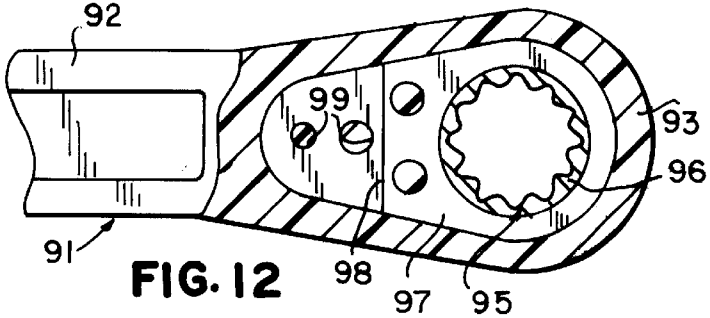
FIG. 12 is a fragmentary sectional view taken along the line 12—12 in FIG. 11.

Principles of the present invention could also be applied to a non-ratcheting box end wrench. Thus, referring to FIGS. 11 and 12, there is illustrated a box end wrench 90 having a non-metallic body 91 with an elongated handle portion 92 and head portions 93 (one shown) at the opposite ends thereof. Embedded in each of the head portions 93 is an annular, fastener-engaging insert 95, preferably formed of a suitable metal and having an axial extent substantially equal to the thickness of the associated head portion 93. If desired, the inserts 95 could be provided on the outer cylindrical surfaces thereof with suitable knurling, ridges or the like, more securely to grip the surrounding plastic and inhibit rotation of the insert 95 in the body 91. Preferably, the body 91 is formed by injection molding and the inserts 95 are insert molded therein. The inserts 95 are respectively disposed through complementary holes 96 in two reinforcing plates 97 (one shown), which are also insert molded in the body 91 centrally of the thickness thereof. The wrench 90 is illustrated as being of the type having offset heads, so the reinforcing plates are correspondingly offset, defining bend lines 98. Also formed through each of the reinforcing plates 97 is a plurality of holes 99 for receiving the body material therethrough, more securely to anchor the reinforcing plates 97 in place. The reinforcing plates 97 function in substantially the same manner described above, for strengthening the wrench 90 and for shifting the failure locations from the head portions 93 toward the handle portion 92 to failure that results in multiple pieces.

Figure 13:
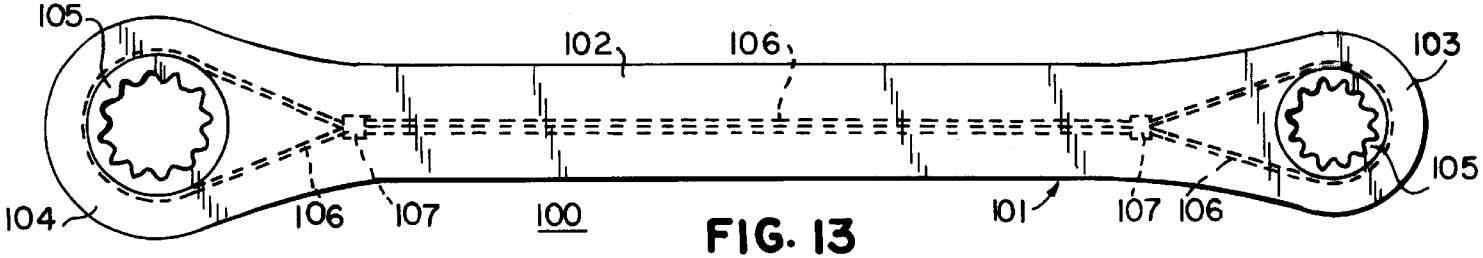
FIG. 13 is a top plan view of a non-ratcheting box end wrench incorporating a reinforcing structure in accordance with another embodiment of the invention.

The reinforcing plates 97 could be replaced by a reinforcing structure in the nature of an elongated, continuous band or loop. Thus, referring to FIG. 13, there is illustrated a composite box end wrench 100 having a non-metallic body 101 including a handle portion 102 and head portions 103 and 104, respectively having fastener-engaging inserts 105 embedded therein, as described above. Also embedded in the body 101, as by insert molding, is an elongated, continuous, reinforcing band 106, which loops around the inserts 105 and extends the length of the body 101. Preferably, the opposite sides of the band 106 are held together by a plurality of fasteners 107 (two shown) between the head portions 103 and 104 to position the band 106 centrally of the handle portion 102. The reinforcing band 106 could be formed of a suitable metal or, alternatively, could be formed of a non-metallic material of suitable strength, such as a pultruded ribbon of reinforced nylon or other suitable material of adequate strength. Also, while the inserts 95 and 105 described above are preferably formed of a suitable-strength metal, such as steel, they could also be formed of non-sparking materials, such as non-sparking metal or a non-metallic material of suitable strength, toughness and wear resistance.

Figure 14:
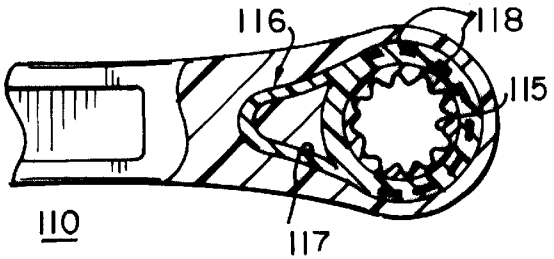
FIG. 14 is a fragmentary top plan view of another wrench similar to that of FIG. 13, incorporating yet another embodiment of reinforcing structure.

Referring to FIG. 14, there is illustrated another alternative embodiment of the present invention in the nature of a box end wrench 110 having a non-metallic body in which is embedded a fastener-engaging insert 115. The wrench 110 may be substantially the same as the wrenches 90 and 100 described above, except that in this case the reinforcing structure is in the nature of a skeleton reinforcing frame 116 which, in addition to the large hole for receiving the insert 115, has a large opening 117 and a plurality of smaller holes or openings 118 extending around the insert 115 for receiving plastic material therethrough for anchoring purposes. Again, the reinforcing frame 116 could be formed of a suitable metal or, alternatively, of a suitable-strength non-metallic material.

Figure 15:
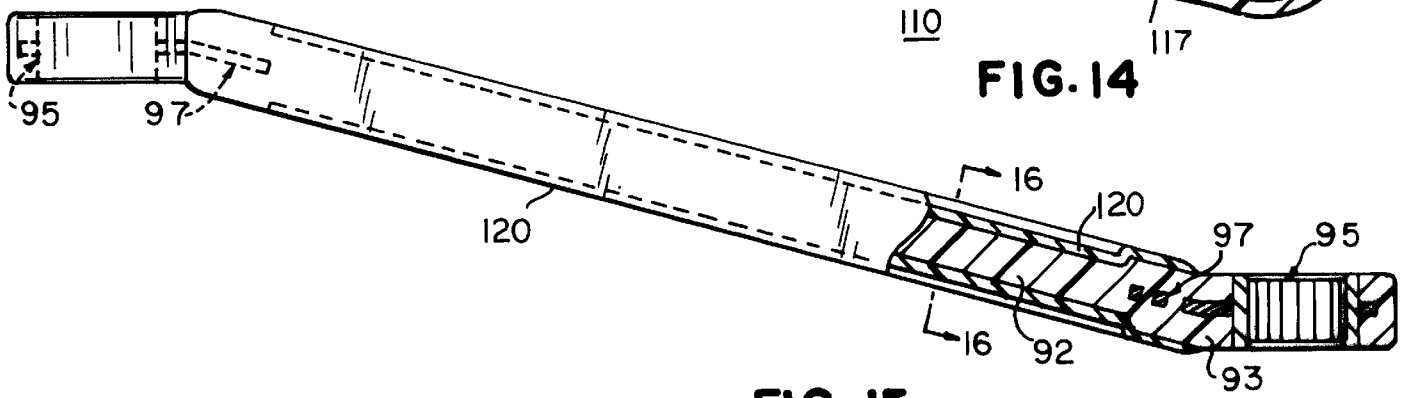
FIG. 15 is a side elevational view in partial section of a wrench similar to that of FIG. 11, in accordance with still another embodiment of the invention.
Figure 16:
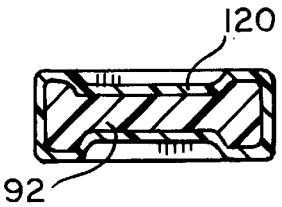
FIG. 16 is a sectional view taken along the line 16—16 in FIG. 15.

Referring also to FIGS. 15 and 16, there is illustrated another embodiment of the present invention, which includes a box end wrench substantially identical to the wrench 90 described above in connection with FIGS. 11 and 12, except that in this case the inner body 91 of the wrench is provided with an outer sheath 120 which substantially surrounds the handle portion 92. The sheath 120 is formed of a suitable non-metallic material which is more flexible than the inner body 91, preferably a tough polymer, such as nylon 6, and may be applied by over molding the handle portion 92. Also, the sheath 120 could be formed of a material which provides a soft feel to the touch to improve the ergonomics of the wrench and for enhanced gripping characteristics. In use, the sheath 120 will serve to retain parts of the wrench intact in the event of possible overload failure. In this regard, because the reinforcing plates 97 will tend to shift the failure location into the handle portion 92, it has been deemed necessary only encapsulate the handle portion to achieve this object.

Figure 17:
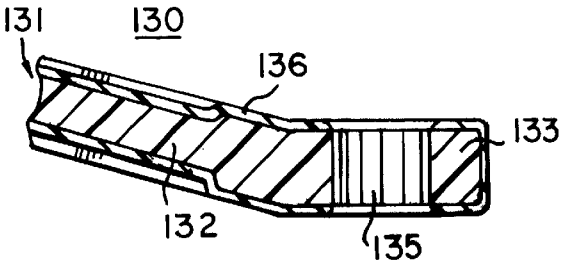
FIG. 17 is a fragmentary view similar to the right-hand end of FIG. 15, illustrating another alternative embodiment of the present invention.

Referring to FIG. 17 there is a similar embodiment in the nature of a box end wrench 130 having a non-metallic body 131 with a handle portion 132 and head portions 133 (one shown). In this case, each of the head portions 133 has a fastener-engaging opening 135 molding directly therein, rather than being provided by an insert. In this case, where the wrench has no insert molded parts, there is provided an outer sheath 136 which covers the entire wrench body 131, except for the inside of the fastener-engaging openings 135. Thus, the sheath 136, which could be applied by overmolding or dipping, will tend to retain the pieces of the wrench intact upon possible overload failure, regardless of where that failure may occur along the wrench.

From the foregoing it can be seen that there has been provided an improved box end wrench of non-metallic construction, of either the ratcheting or non-ratcheting type, including embedded fastener-engaging inserts provided with reinforcing structure to strengthen the wrench and to change the failure mode thereof such that the wrench tends not to fracture into more than one piece, all while achieving a relatively simple and economical construction. There is also provided an improved wrench construction with an outer sheath for retaining parts of the wrench intact in the event of overload failure, as well as providing a more comfortable grip.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A wrench comprising:

a handle formed entirely of non-metallic material; and a head at an end of the handle, the head including a non-metallic body, a metal workpiece-engaging member encompassed by the body so as to secure the member to the body, and a one-piece reinforcing structure discrete from the workpiece-engaging member and from the body and embedded in the body and encompassing the workpiece-engaging member.

2. The wrench of claim 1, wherein the reinforcing structure is in the form of a plate.

3. The wrench of claim 2, wherein the plate has a plurality of apertures therein for receiving the non-metallic material therethrough to facilitate anchoring the plate in the body.

4. The wrench of claim 1, wherein the reinforcing structure is formed of metal.

5. A box end wrench comprising:

a handle formed entirely of non-metallic material, a head at an end of the handle, a body including two parts formed of non-metallic material and each having a handle portion and a head portion which defines an opening, each of said head portions including a reinforcing plate embedded therein and confined thereto and encompassing the opening, said parts being joined together to form the body with the handle portions forming the handle and the head portions forming the head with the openings aligned to define a hole through the head, and a fastener-engaging member captured between the head portions and disposed in the hole for engagement with the reinforcing structures.

6. The wrench of claim 5, wherein each of said plates has a plurality of apertures therein for receiving said non-metallic material therethrough.

7. The wrench of claim 5, where each of said reinforcing plates is formed of metal.

8. The wrench of claim 5, wherein said fastener-engaging member is a ratchet gear rotatably disposed in said head, and further comprising a pawl mechanism including a pawl disposed between said head portions for ratcheting engagement with the gear.

9. The wrench of claim 8, wherein each of said reinforcing plates is disposed for encompassing engagement with each of said gear and said pawl for holding them together.

10. The wrench of claim 5, wherein said fastener-engaging member is encompassed by the head.

11. The wrench of claim 1, wherein the wrench is a box end wrench, the workpiece-engaging member comprising a fastener-engaging member embedded in the head portion and defining a fastener-receiving opening.

12. The wrench of claim 5, wherein each of said reinforcing plates extends into the handle portion of the associated part.

13. The wrench of claim 5, wherein said fastener-engaging member has an exposed outer peripheral portion.

14. The wrench of claim 5, and further comprising a spacer member disposed between and fixed to the handle portions of said parts for maintaining a separation between said head portions.

15. A box end wrench comprising:

a handle formed entirely of non-metallic material, a head at an end of the handle, a body including two parts formed of non-metallic material and each having a handle portion and a head portion which defines an opening, each of the head portions including a reinforcing plate embedded therein and confined thereto and encompassing the opening, the parts being joined together to form the body with the handle portions forming the handle and the head portions forming the head with the openings aligned to define a hole through the head, and a workpiece-engaging member captured between the head portions and disposed in the hole for engagement with the reinforcing structures.

16. A wrench comprising:

a handle formed entirely of non-metallic material; and a head at an end of the handle, the head including a non-metallic body, a workpiece-engaging ratchet gear rotatably disposed in the head, a pawl mechanism disposed for ratcheting engagement with the gear, and a one-piece reinforcing structure discrete from the workpiece-engaging member and from the body and embedded in the body and encompassing the workpiece-engaging member.

17. The wrench of claim 16, wherein the reinforcing structure is disposed for encompassing engagement with each of the gear and the pawl mechanism for holding them together.

18. The wrench of claim 16, wherein the reinforcing structure is formed of a material different from that of the body.

19. The wrench of claim 1, wherein the reinforcing structure extends into the handle.

20. The wrench of claim 1, wherein the reinforcing structure is formed of a non-metallic material.

21. The wrench of claim 1, and further comprising a second head at a second end of the handle, the second head including a second non-metallic body, and a second metal workpiece-engaging member encompassed by the body so as to secure the member to the body, the reinforcing structure including an elongated band extending around both of the workpiece-engaging members.

22. The wrench of claim 1, wherein the workpiece-engaging member is a ratchet gear rotatably disposed in the head, and further comprising a pawl mechanism disposed for ratcheting engagement with the gear, the reinforcing structure being disposed for encompassing engagement with each of the gear and pawl mechanism for holding them together.

23. The wrench of claim 22, wherein the gear includes a hub portion and the pawl mechanism includes a pivot portion, the reinforcing structure including a band extending around the hub portion and the pivot portion.

* * * * *